US006827784B1

(12) United States Patent
Kern

(10) Patent No.: US 6,827,784 B1
(45) Date of Patent: Dec. 7, 2004

(54) CORRUGATING METHOD AND MEANS

(75) Inventor: Steven J. Kern, Portland, OR (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 10/748,908

(22) Filed: Dec. 30, 2003

(51) Int. Cl.[7] ..... B05C 1/08

(52) U.S. Cl. ..... 118/693; 118/694; 118/696; 118/227; 118/249; 118/262; 156/462; 156/472; 156/578

(58) Field of Search ..... 118/693, 694, 118/696, 227, 249, 262, 600, 602; 156/205, 210, 462, 470–472, 578; 427/345

(56) References Cited

U.S. PATENT DOCUMENTS 5,899,563 A * 5/1999 Karras ..... 366/152.3
6,458,417 B2 * 10/2002 Nasli-Bakir et al. ..... 427/345
2003/0075294 A1 * 4/2003 Winkle ..... 162/322

* cited by examiner

*Primary Examiner*—Laura Edwards
(74) *Attorney, Agent, or Firm*—Cynthia L. Foulke

(57) ABSTRACT

A system for adding a desired additive to a corrugating adhesive.

20 Claims, 4 Drawing Sheets

CORRUGATING METHOD AND MEANS

FIELD OF THE INVENTION

The present invention relates to corrugating converting machinery, more particularly to equipment for the dosing of various desired additives to the corrugating adhesive used in the manufacture of corrugated board.

BACKGROUND OF THE INVENTION

Corrugated paper board is commonly prepared by first forming a corrugated element or core by passing a cellulosic sheet between corrugating rolls forming a substantially sinusoidal or serpentine cross-section in the sheet. An adhesive is commonly applied to the tips of the thus formed sinusoidal portion called flutes and a noncorrugated or planar cellulosic liner is applied against the adhesive coated flutes of the corrugated elements as the corrugated sheet passes between a corrugating roll and a pressure roll. The resulting paper product having the corrugating medium on one side and the planar liner on another side is called a single-faced element. The single-faced element may be used as is in certain applications as a liner or buffer material within a container. More commonly adhesive is applied to the flute tips of the single-faced element and a second liner sheet is subsequently applied to the adhesive liner in a "double facer" operation. The second liner sheet is exposed to conditions of heat and pressure during its contact with the adhesive. In practice, the sheet of corrugated cardboard most frequently encountered has two plane sides placed on each side of the corrugated core. Depending on the specific strength desired, a sheet of corrugated cardboard may also be provided with a more complex structure, such as two corrugated cores and three plane surfaces, two outer ones and one inner one separating the two corrugated cores. This is referred to as double wall board.

Starch-based adhesives are most commonly used in the corrugating process due to their desirable adhesive properties, low cost and ease of preparation. The most fundamental of starch corrugating adhesives is an alkaline adhesive which is comprised of raw, ungelatinized starch suspended in an aqueous dispersion of cooked starch. The adhesive is produced by gelatinizing starch in water with sodium hydroxide (caustic soda) to yield a primary mix of gelatinized or cooked carrier, which is then slowly added to a secondary mix of raw (ungelatinized) starch, borax and water to produce the full-formulation adhesive. In the corrugating process, the adhesive is applied (usually at between 25° and 55° C.) to the tips of the fluted paper medium or single-faced board, whereupon the application of heat causes the raw starch to gelatinize, resulting in an instantaneous increase in viscosity and formation of the adhesive bond.

The typical corrugating process and the operation and use of corrugators in general are described in U.S. Pat. Nos. 2,051,025 and 2,102,937 issued on Aug. 18, 1936 and Dec. 21, 1937, respectively, to Jordan Bauer.

In addition to starch, caustic, borax and water, various additives have been used to modify the properties of the adhesive an/or the resulting corrugated cardboard. Such additives include preservatives, water resistance additives, defoamers, colorants, wetting agents, urea and performance additives that increase tack or rate of green bond formation. For example, corrugating adhesives can be rendered moisture resistant or water-resistant by the addition of materials such as ketone aldehydes. These materials cross-link the starch molecules making it more difficult for water to dissolve the starch. Urea appears to hold moisture at the glue line and helps improve bonds, particularly at the single facer. The above-described additives are typically post-added to the formulated water-starch-caustic-borax-containing corrugating adhesive in order to obtain or enhance certain properties.

It would be desirable to have methods and means to add a desired component in a predetermined amount to a corrugating adhesive and to monitor how much component is added, how much has been used, how much remains, and when stock is in need of replenishment/reorder. The current invention fulfills this need.

SUMMARY OF THE INVENTION

The invention is directed to a corrugating adhesive system comprising at least one adhesive storage tank where prepared adhesive is stored prior to use, at least one day tank, a means for adding a predetermined amount of a predetermined additive to a predetermined day tank for delivery to a predetermined area of the corrugator, and a means for recycling the adhesive from the corrugator back to the day tank or, alternatively, back to the storage tank.

One embodiment of the invention provides a corrugating system comprising a corrugating apparatus containing at least a single facer machine, a storage tank for storing a formulated adhesive, a day tank for holding a predetermined amount of a formulated adhesive and a predetermined amount of at least one predetermined additive, a source of a predetermined additive, a means for moving a predetermined amount of said formulated adhesive from said storage tank to said day tank, a means for moving a predetermined amount of said additive from said source to said day tank, and a means for moving said additive-containing adhesive from said day tank to said corrugating apparatus. In response to movement of a predetermined amount of said formulated adhesive from said storage tank to said day tank, a predetermined amount of said predetermined additive is moved from the source of said additive to said day tank.

The corrugating systems of the invention will also comprise a means for recycling the adhesive from the corrugator back to the day tank and a means for recycling the adhesive from the corrugator back to the storage tank.

Typically, the corrugating system will comprise at least two day tanks, a source of a first additive and a source of at least a second additive. The source of the additive is not particularly limiting and may be a drum, a tote, bulk storage tank, or the like.

In a second embodiment, a computer integrated corrugating system is provided which system will preferably comprise a means for moving a predetermined amount of said formulated adhesive from said storage tank to said day tank in response to a signal indicating a need for replenishing said tank with adhesive, a means for moving a predetermined amount of said predetermined additive from said source to said day tank in response to a signal indicating a need to replenish said tank with additive. In preferred systems, a means to signal when a predetermined low amount of additive remains in said source is provided, as well as a means to reorder predetermined quantities of additive in response to said signal.

BRIEF DESCRIPTION OF THE DRAWING FIGURES

DETAILED DESCRIPTION OF THE INVENTION

Figure 1:
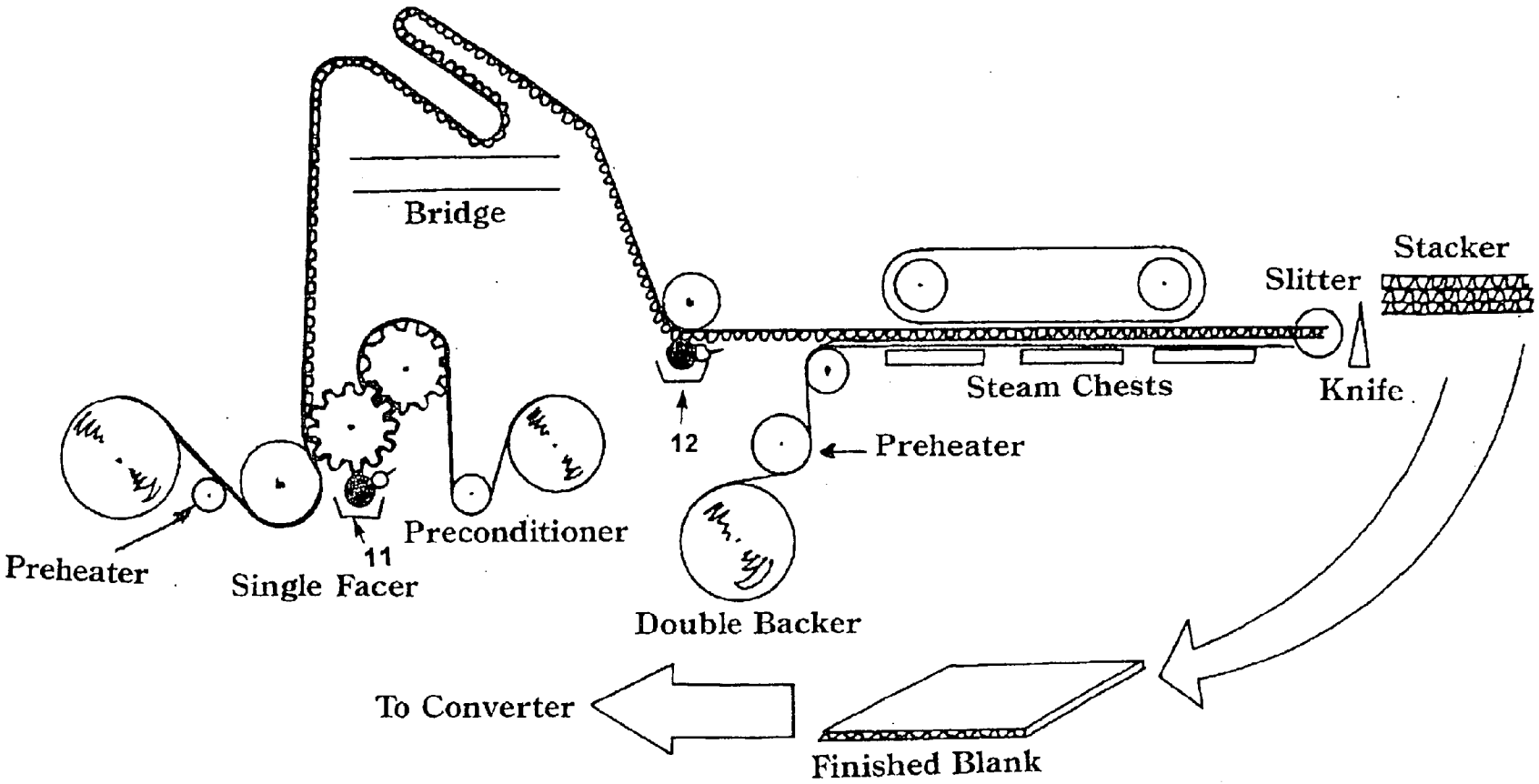
FIG. 1 is a flow diagram illustrating a typical corrugating process. Shown is a single facer glue station (11) and a double backer glue station (12).

All documents cited herein are incorporated in their entireties by reference.

The invention provides a method and a means for the addition of a desired component to a corrugator's adhesive system. In a particularly preferred embodiment, the addition of desired components is automated. The desired component may be added in solid, powder, or liquid form.

Current processes for adding additives is a system that is either "on" or "off". The system of the invention provides an automatic system that will put a desired additive into the adhesive at a desired level at a desired time. Moreover, the system can be structured to run in conjunction with a corrugating company's order entry, scheduling, accounting, corrugator interface program or related download or link program.

The invention provides a corrugating adhesive system comprising at least one adhesive storage tank where prepared adhesive is stored prior to use, at least one day tank, and a means for adding a predetermined amount of a predetermined additive to a predetermined day tank for delivery to a predetermined area of the corrugator.

The corrugating system of the invention will comprise a corrugating apparatus containing at least a single facer machine, a storage tank for storing a formulated adhesive, a day tank for holding a predetermined amount of a formulated adhesive and a predetermined amount of at least one predetermined additive, a source of a predetermined additive, a means for moving a predetermined amount of said formulated adhesive from said storage tank to said day tank, a means for moving a predetermined amount of said additive from said source to said day tank, and a means for moving said additive-containing adhesive from said day tank to said corrugating apparatus. Typically, the corrugating system will comprise at least two day tanks, a source of a first additive and a source of at least a second additive. The source of the additive is not particularly limiting and may be a drum, a tote, bulk storage tank, or the like. Means for moving or transporting adhesive in accordance with the practice of the invention will be readily apparent to corrugating practitioners and will include, but are not limited to, hoses and like transporting means.

In response to movement of a predetermined amount of said formulated adhesive from said storage tank to said day tank, a predetermined amount of said predetermined additive is moved from the source of said additive to said day tank.

The invention allows addition of a desired component or additive (e.g., a water-resistant resin) to the adhesive depending on, e.g., the type of starch used in the adhesive formulation (pearl starch, high amylose starch, etc), the type of corrugating board that is to be manufactured (e.g., water-resistant board) and the like. For example, if water resistance is not needed, addition of water resistance resins is omitted, resulting in substantial cost savings. Also, since a water resistant adhesive (WRA) should be used up within 6 to 24 hours after the crosslinking agent is added to the adhesive, the invention provides a method of freshly resinating only that portion or quantity of an starch adhesive that will be used in a particular run.

The type and amount of additive is not limiting, and the invention may be used to add any desired additive in any desired level to any desired adhesive. Particularly preferred adhesive additives that will typically be added in practice of the invention are water resistance additives and performance enhancing additives.

The invention will be described in more detail by reference to drawing FIGS. 1–5.

FIG. 1 is a flow diagram illustrating a typical corrugating process well known to those skilled in the corrugating art. Shown is a single facer glue station (11) and a double backer glue station (12).

Figure 2:
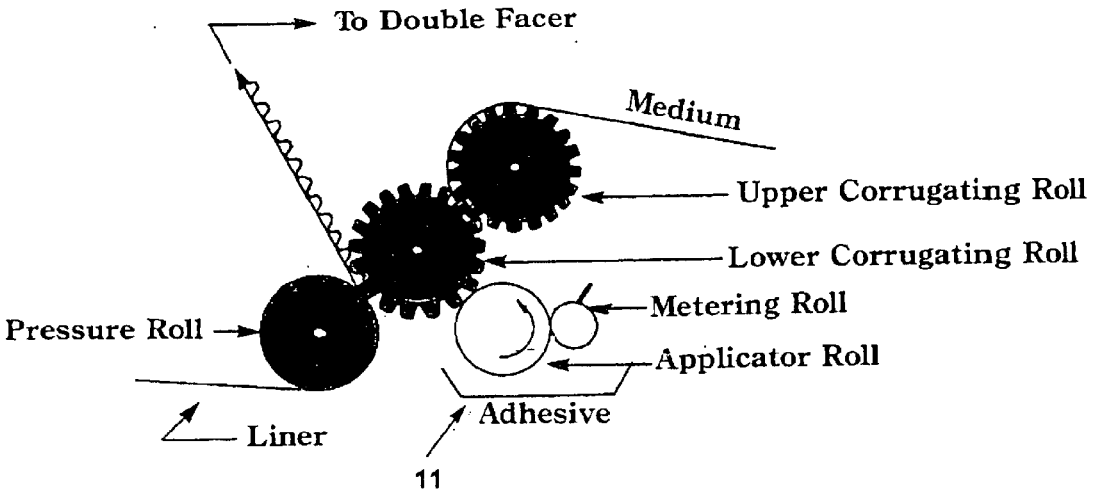
FIG. 2 is a close-up view of the single facer gluing station (11) show in FIG. 1.

FIG. 2 is a close-up view of the single facer gluing station (11) show in FIG. 1. At the single facer, flutes are being formed and bonded at rates approaching 600 per second with high temperatures and high pressures. At normal operating speeds, as the web emerges from the single facer, a tenuous "green bond" usually exists so that drying and final bond formation must be effected on the bridge (shown in FIG. 1).

Figure 3:
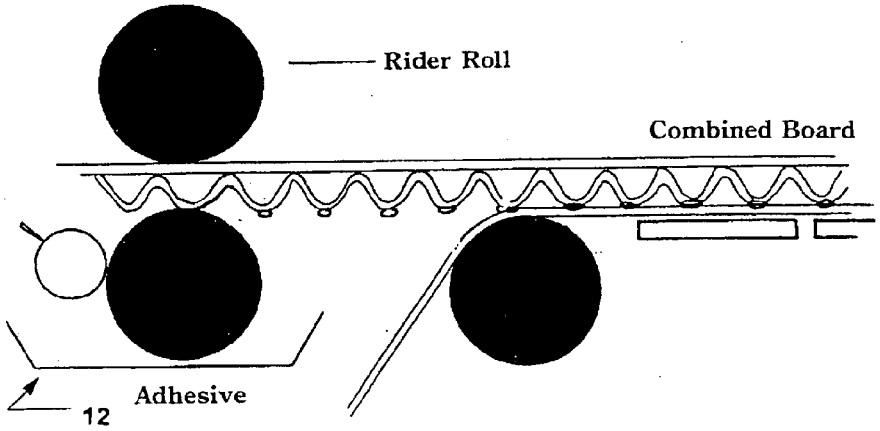
FIG. 3 is a close-up view of the double backer gluing station (12) shown in FIG. 1.

FIG. 3 is a close-up view of the double backer gluing station (12) shown in FIG. 1. At the doublebacker, the time between application of the adhesive to the flute tip and final green bond formation may be many times greater than at the singlefacer therefore requiring adhesives having good wet tack development.

Figure 4:
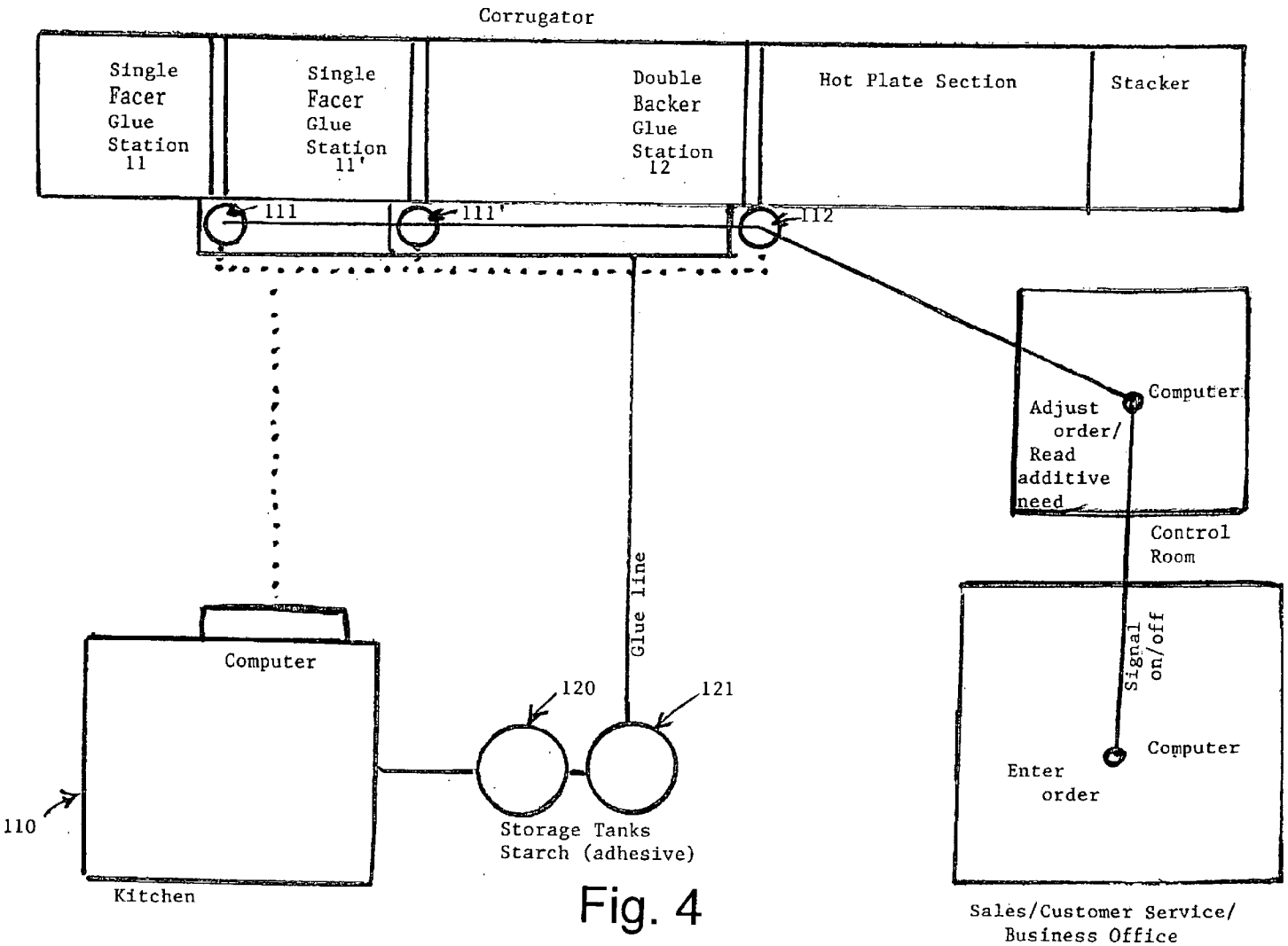
FIG. 4 is a flow diagram of an addition system of the invention.

FIG. 4 is a flow diagram illustrating the addition system of the invention. Shown is a corrugator comprising two single facer glue stations (11 and 11') and a double backer glue station (12). Adhesive raw materials (water, starch, caustic, borax) are mixed together in a tank conventionally referred to in the art as a starch "kitchen" (110). The formulated corrugating adhesive is then fed to one or more tanks (120 and 121) where the formulated adhesive is stored prior to use. The storage tank(s) (120 and 121) feed "day" tanks (111, 111' and 112). A single day tank may replenish or feed more than glue station or, in some embodiments each day tank will feed a respective glue station. A single day tank may feed all the single facers and a second day tank may feed the glue stations at the double backer. Alternatively, one day tank may feed only a specific single glue station. In FIG. 4, day tanks 111, 111' and 112 feed single facer glue station (11), single facer glue station (11') and double backer glue station (12), respectively.

When the system is on, as more adhesive is added to the day tank from the storage tank(s), the system will dose each day tank with the required predetermined additive in the required amount. An auxiliary equipment (unit) useful for metering/dosing of additives for corrugated converting machinery is designed to provide a convenient and accurate means of metering additives into the adhesive mixture that has been pumped into the day tank of a corrugated converting system. Additive products are pumped at a controlled rate from supply containers into the day tank, then agitated for mixing to proper consistency.

The type and size of metering unit is not limited. The units may be e.g., electrical pump, air pump etc. Size will vary depending on, e.g., the number of day tanks fed, the number of metering rates available for selection or the like. For example, a multiple position reflector may be present enabling the selection of, e.g., one of three different predetermined levels such as 5%, 10 or 25% and 1%, 2% or 3%.

It will be appreciated that based on the corrugated product to be made, different additive or combination of additives may be added to different tanks. That is, the adhesive present in one day tank that feeds a single facer glue station, may be different than the adhesive present in a second day tank that feeds a second single facer glue station or a double backer glue station. The adhesive may be different in terms of the presence or absence of additive, in terms of the amount of an additive, in terms of the selection or type of additive, or combinations thereof. That is, the system may be programmed to deliver water resistance resins to only a single day tank, or to all operating day tanks. Or, the system may be programmed to deliver a first additive to a first day tank and a second additive to a second day tank. A single additive may be delivered to more than one day tank and/or more than one additive may be added to a single day tank. By addition of additives to the adhesive in the day tank, rather than to the adhesive present in the storage tanks, the adhesive can be tailored to achieve specific desired performance requirements. In addition, efficient changeover from run to run, e.g., from manufacturing board requiring water resistance to board that does not require water resistance, especially when running small jobs may be obtained.

Figure 5:
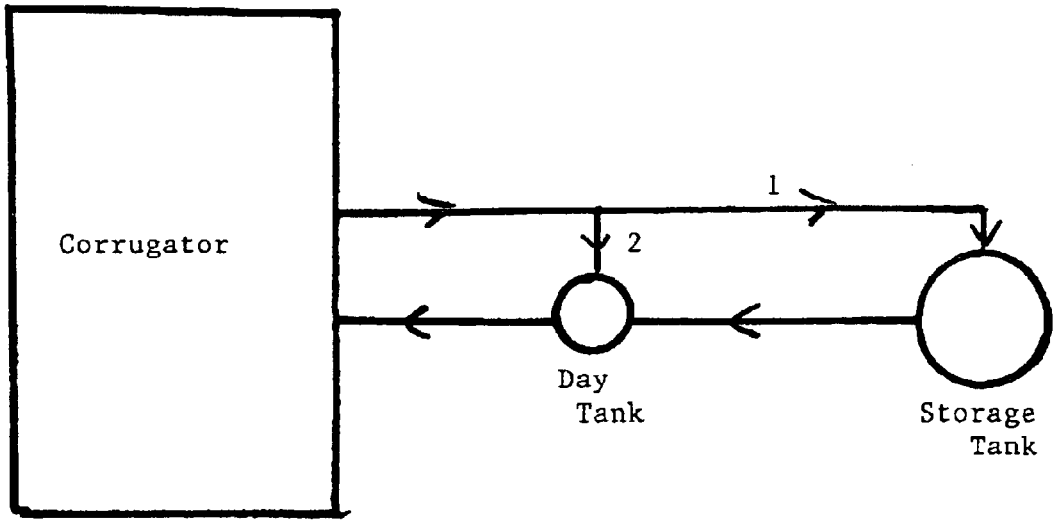
FIG. 5 is a flow diagram of the recirculation of adhesive from the storage tank to the day tank to the corrugator and then back to the storage tank or, alternatively, the day tank.

Adhesive present in the corrugator will be recycled. FIG. 5 is a schematic showing recirculation of adhesive from the storage tank to the day tank, to the corrugator, and then back to the storage tank (1) or, alternatively, the day tank (2). If the adhesive from the corrugator is free of additives, it will be preferable recycled to the storage tank. If the adhesive from the corrugator contains additives, it will be recycled to the day tank.

The invention provides a computer integrated corrugating system, which system will preferably comprise a means for moving a predetermined amount of said formulated adhesive from said storage tank to said day tank in response to a signal indicating a need for replenishing said tank with adhesive, a means for moving a predetermined amount of said predetermined additive from said source to said day tank in response to a signal indicating a need to replenish said tank with additive. In preferred systems, a means to signal when a predetermined low amount of additive remains in said source is provided, as well as a means to reorder predetermined quantities of additive in response to said signal.

Computer controls may be located in the starch kitchen, or at a more remote location. The system may be fully automated/computerized, or only partially automated/computerized. Desirably, an output signal would be sent alerting when the additive level is low and, preferable, prompt an automatic order entry, scheduling, accounting, corrugator interface program or related download or link program.

The description of one embodiment of the invention, illustrating addition of a performance enhancer and a water resistance resin, is described below. The invention is not, however, to be limited thereto. While the unit described below is a stand-alone unit, it is understood that this equipment may, if desired, be adapted for integration into a larger control network.

EXAMPLE

A portable additive metering unit is mounted on a 27" high stand with a footprint of 24"×30." Electrical and controls systems are enclosed in a NEMA 4 Rated cabinet secured with a hasp. Metering pumps are driven by washdown-rated 3-phase motors. The performance enhancer metering unit additive pump is rated at 3.1 gpm. The water resistant additive metering unit additive pump is rated at 3.1 gpm.

A 3-phase electric-motor-driven agitator is mounted in the day tank. Space for a disconnect is provided on the mounting stand. The unit comprises an operator interface and a control panel. The control panel comprises a main power with pilot light, performance additive switch with pilot light, water resistance additive switch with pilot light, run/dosing indicator, and a 3-position "selector switch" for 1%, 2%, or 3% metering rate for the additive.

Inside the cabinet is a manual dosing/run switch and an internal counter, recording cumulative number of doses metered.

In operation, the controls sense when the day tank refill pump turns on. As the cycle is initiated, 3-phase mixing unit engages. Then there is a 2 second delay before the selected additive pump/s is/are turned on. The additive pumps are programmed to run for the prescribed dosages. The amount of material delivered during this cycle is determined by the speed at which the pumps are operating and the number of pump revolutions. This speed is controlled by an internal voltage setting determined at the time of installation in relation to the capacity of the day tank of each specific converting system. After the additive pump(s) time out, the agitator continues to run for another 6 minutes.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

What is claimed is:

1. A corrugating system comprising a corrugating apparatus containing at least a single facer machine, a storage tank for storing a formulated adhesive, a day tank for holding a predetermined amount of a formulated adhesive and a predetermined amount of at least one predetermined additive, a source of a predetermined additive, a means for moving a predetermined amount of said formulated adhesive from said storage tank to said day tank, a means for moving a predetermined amount of said additive from said source to said day tank, and a means for moving said additive-containing adhesive from said day tank to said corrugating apparatus.

2. A corrugating system of claim 1 wherein, in response to movement of a predetermined amount of said formulated adhesive from said storage tank to said day tank, a predetermined amount of said predetermined additive is moved from the source of said additive to said day tank.

3. The corrugating system of claim 1 comprising means for recycling the adhesive from the corrugating apparatus back to the day tank.

4. The corrugating system of claim 1 comprising means for recycling the adhesive from the corrugating apparatus back to the storage tank.

5. The corrugating system of claim 1 comprising at least two day tanks.

6. The corrugating system of claim 5 comprising a source of a first-additive and a source of at least a second additive.

7. The corrugating system of claim 1 wherein said source is a drum, a tote or a bulk storage tank.

8. The corrugating system of claim 1 comprising a means to signal when a predetermined low amount of additive remain in said source.

9. The corrugating system of claim 8 comprising means to reorder predetermined quantities of additive in response to said signal.

10. The corrugating system of claim 1 which is at least partially automated.

11. A computer integrated corrugating system comprising a corrugating apparatus containing at least a single facer machine, a storage tank for storing a formulated adhesive, a day tank for holding a predetermined amount of a formulated adhesive and a predetermined amount of at least one predetermined additive, a source of at least one predetermined additive, a means for moving a predetermined amount of said formulated adhesive from said storage tank to said day tank in response to a signal indicating a need for replenishing said tank with adhesive, a means for moving a predetermined amount of said predetermined additive from said source to said day tank in response to a signal indicating a need to replenish said tank with additive, and a means for moving said additive from day tank to said corrugating apparatus.

12. The corrugating system of claim 11 wherein, in response to movement of a predetermined amount of said formulated adhesive from said storage tank to said day tank, a predetermined amount of said predetermined additive is moved from the source of said additive to said day tank.

13. The corrugating system of claim 11 comprising means for recycling the adhesive from the corrugating apparatus back to the day tank.

14. The corrugating system of claim 11 comprising means for recycling the adhesive from the corrugating apparatus back to the storage tank.

15. The corrugating system of claim 11 comprising at least two day tanks.

16. The corrugating system of claim 15 comprising a source of a first additive and a source of at least a second additive.

17. The corrugating system of claim 1 wherein said source is a drum, a tote or a bulk storage tank.

18. The corrugating system of claim 11 comprising a means to signal when a predetermined low amount of additive remain in said source.

19. The corrugating system of claim 18 comprising means to reorder predetermined quantities of additive in response to said signal.

20. The corrugating system of claim 11 which is fully automated.

* * * * *